US006960733B2

(12) United States Patent
Hanahara et al.

(10) Patent No.: US 6,960,733 B2
(45) Date of Patent: Nov. 1, 2005

(54) LIGHTED SWITCH SHEET AND LIGHTED SWITCH UNIT USING THE SAME

(75) Inventors: Tetsuro Hanahara, Fukui (JP); Takayuki Ishikawa, Fukui (JP); Yoshiharu Abe, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 128 days.

(21) Appl. No.: 10/455,126

(22) Filed: Jun. 5, 2003

(65) Prior Publication Data

US 2004/0007968 A1 Jan. 15, 2004

(30) Foreign Application Priority Data

Jun. 6, 2002 (JP) ..... 2002-165802

(51) Int. Cl.[7] ..... H01H 9/18

(52) U.S. Cl. ..... 200/314

(58) Field of Search ..... 200/314; 341/22

(56) References Cited

U.S. PATENT DOCUMENTS

| | | | | |
|---|---|---|---|---|
| 4,320,268 | A * | 3/1982 | Brown | 200/5 A |
| 6,369,801 | B2 * | 4/2002 | Boireau et al. | 200/314 |
| 6,467,924 | B2 * | 10/2002 | Shipman | 200/314 |
| 6,590,508 | B1 * | 7/2003 | Howell et al. | 200/5 A |
| 6,747,402 | B2 * | 6/2004 | Hato et al. | 200/310 |
| 6,764,191 | B2 * | 7/2004 | Douzono et al. | 362/84 |

* cited by examiner

*Primary Examiner*—Renee Luebke
(74) *Attorney, Agent, or Firm*—RatnerPrestia

(57) ABSTRACT

A lighted switch sheet of the invention has a structure, which comprises a sheet having a plurality of movable contacts of a hemispherical shape disposed in a plurality of fixing holes, and an EL element affixed on an upper surface of the sheet. The EL element has an optically transmitting substrate provided with an optically transmitting electrode layer, light-emitting layer and back electrode layer formed in an overlapping manner on an underside surface thereof, and through holes of a size slightly smaller than an outer diameter of the movable contacts formed above their respective movable contacts. The invention provides for the lighted switch sheet with a small number of structural components and a simple structure at low cost.

13 Claims, 3 Drawing Sheets

LIGHTED SWITCH SHEET AND LIGHTED SWITCH UNIT USING THE SAME

TECHNICAL FIELD

The present invention relates to lighted switch sheets used for lighting control panels of a variety of electronic apparatuses such as cellular phones, personal computers, and the like. The invention also relates to lighted switch units using the same.

BACKGROUND OF THE INVENTION

There is a rapid progress in performance and diversification in recent years of a variety of electronic apparatuses such as cellular phones and personal computers, and the like. In pace with the progress, a strong demand exists for means to make control panels such as push buttons legible and operable even in a dark environment. There is thus an increase in number of apparatuses that illuminate control panels using lighted switch units and lighted switch sheets provided with various kinds of light-emitting devices. A lighted switch unit of such kinds of the prior art will be described hereinafter with reference to FIG. 6.

FIG. 6 is a cross sectional view of a lighted switch unit of the prior art, wherein wiring board 1 provided with a plurality of wiring patterns (not shown in the figure) formed on both upper and lower surfaces also has a plurality of center stationary contacts 2A as well as a plurality of outer stationary contacts 2B formed on the upper surface.

Each of movable contacts 3 made of resilient thin metal plate has generally a hemispherical shape with a convexed center, and it is affixed on wiring board 1 with tape 4 backed by adhesive (not show in the figure) in a manner that a bottom peripheral edge is positioned on outer stationary contact 2B.

Light emitting diodes 5 (hereafter referred to as "LED") are mounted also on the upper surface of wiring board 1 in the vicinity of movable contacts 3.

Each push button 6 made of dark-colored insulating plastic has indicator face 6A of translucent, milk-white or the like colored material marked with a character, a symbol, a pictorial sign or the like on the upper surface, and depressing boss 6B on the lower surface. Depressing boss 6B protrudes downward and a bottom end of it abuts upon a top center portion of movable contact 3 through tape 4. A plurality of these push buttons 6 project through openings 7A provided in casing 7 formed of insulating plastic of an electronic apparatus. The lighted switch unit having the structure as described above is used for an electronic apparatus of the prior art.

Description will be provided next of an operation of the lighted switch unit of the prior art having the above-described structure.

When any of push buttons 6 is pushed downward, a bottom end of depressing boss 6B depresses the top center portion of the corresponding movable contact 3, causing it to invert with a click feeling. The inversion of movable contact 3 causes a lower center surface of it to contact with center stationary contact 2A, and completes an electrical connection between center stationary contact 2A and outer stationary contact 2B through movable contact 3.

Next, when the depressing force is removed from push button 6, a resilient restoring force of movable contact 3 disconnects the lower center surface from center stationary contact 2A, and pushes back push button 6 upward at the same time to restore it into the original state shown in FIG. 6.

In addition, a predetermined operation causes a plurality of LEDs 5 to emit light for illumination of push buttons 6 from the underside, to help a user to locate any of push buttons 6 and see the characters and the like on indicator faces 6A easily even in a dark environment.

In the above-described lighted switch unit of the prior art, however, a number of LEDs 5 for illuminating push buttons 6 needs to be increased if the electronic apparatus has a large number of push buttons 6 due to high performance with a wide variation of uses. This results in an increase in number of components as well as a time required for assembly, which gives rise to a problem of high cost.

SUMMARY OF THE INVENTION

The present invention has been devised in light of the above problem of the prior art, and it is therefore an object of this invention to provide a less expensive lighted switch sheet using a small number of components with a simple structure. The invention also provides a lighted switch unit using the lighted switch sheet.

The lighted switch sheet of this invention comprises: a sheet having a plurality of movable contacts of a hemispherical shape; and an electro-luminescent element ("EL element") having an optically transmitting substrate provided with an optically transmitting electrode layer, a luminescent layer and a back electrode layer formed in an overlapping manner on an underside surface thereof, and through holes of a size slightly smaller than an outer diameter of the movable contacts formed above their respective movable contacts, wherein the EL element is affixed on the sheet.

The above structure has an advantage of providing the lighted switch sheet with capability of illuminating a plurality of push buttons above the movable contacts with only one EL element, thereby reducing the number of components, and making it simple in structure and less expensive.

DESCRIPTION OF THE INVENTION

Figure 1:
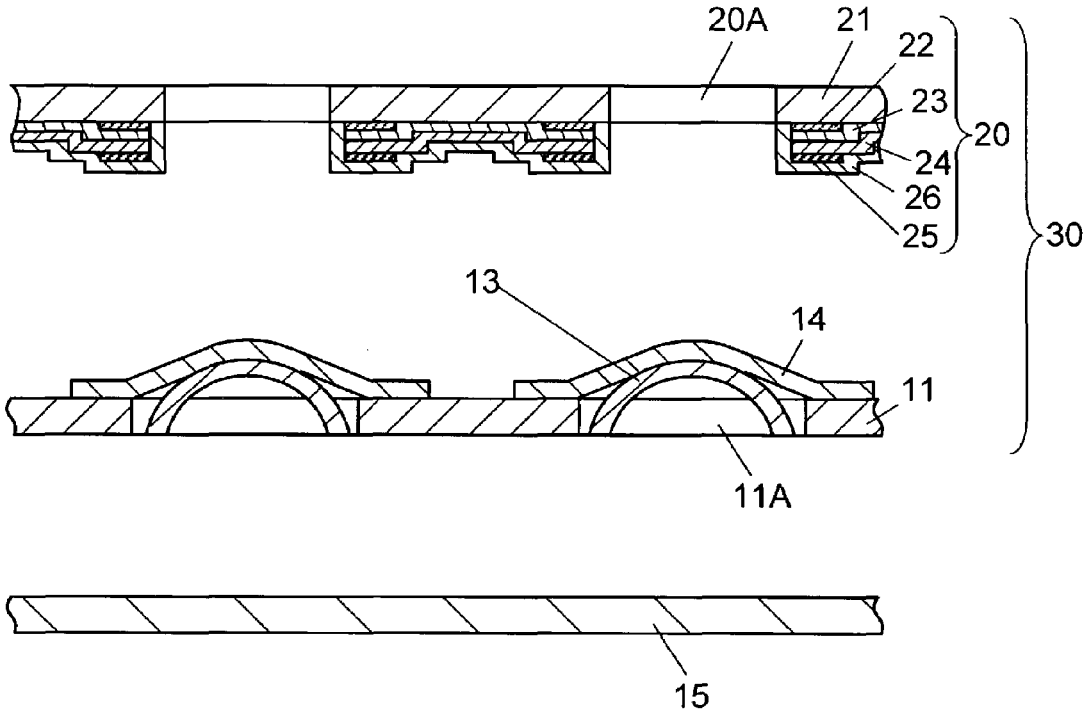
FIG. 1 is an exploded sectional view depicting a lighted switch sheet according to an exemplary embodiment of the present invention.

Referring to FIG. 1 through FIG. 5, description will be provided hereinafter of exemplary embodiments of the present invention.

Individual figures illustrate structures with their dimensions enlarged only in a direction of thickness in order to clarify the details. In addition, like reference numerals are used throughout to designate like structural components as those of the prior art example.

(First Exemplary Embodiment)

A lighted switch sheet of this invention is now described as a first exemplary embodiment.

Figure 2:
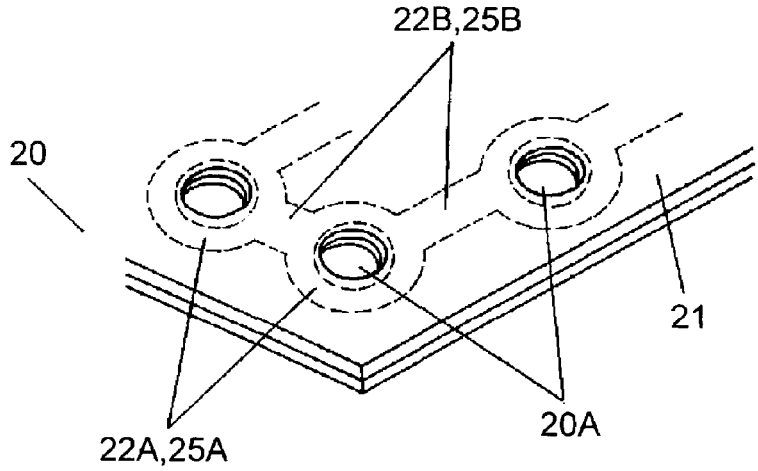
FIG. 2 is a perspective view illustrating a part of an EL element according to the same exemplary embodiment of this invention.

FIG. 1 and FIG. 2 illustrate the exemplary embodiment of this invention. Sheet 11 made of a plastic film such as polyethylene terephthalate, polyimide and the like material is provided with a plurality of fixing holes 11A formed therein as shown in FIG. 1.

Movable contacts 13 are generally in a hemispherical shape with their center convexed upward. They are disposed individually to the plurality of fixing holes 11A in sheet 11, and fixed to sheet 11 with tape 14 having adhesive (not show in the figure) coated on the underside surface. Movable contacts 13 are made of a thin metal plate having resiliency such as copper, copper alloy, and the like.

Further, EL element 20 is placed on the second surface of sheet 11. EL element 20 is provided with a plurality of through holes 20A formed in locations above their corresponding movable contacts 13, through holes 20A having a size slightly smaller than an outer diameter of movable contacts 13. Optically transmitting substrate 21 has optically transmitting electrode layer 22 formed on an underside surface (the third surface) thereof. Optically transmitting electrode layer 22 is formed by the sputtering method, the electron-beam deposition method, or printing of synthetic resin dispersed therein with indium tin oxide or the like. In this exemplary embodiment, substrate 21 comprises a plastic sheet consisting of polyethylene terephthalate, polyimide, or the like material. In FIG. 1, the first surface corresponds to an underside surface of sheet 11, the second surface corresponds to an upside surface of sheet 11, the third surface corresponds to an underside surface of substrate 21 and the fourth surface corresponds to an upside surface of substrate 21.

Optically transmitting electrode layer 22 comprises annular portions 22A defining pattern electrodes formed in surface areas slightly inward from the circumferential edges of the plurality of through holes 20A, and linkage portions 22B connecting the plurality of annular portions 22A. Light-emitting layer 23 and dielectric layer 24 are then printed one after another over the entire surface of optically transmitting electrode layer 22, except for the inner peripheral edges of annular portions 22A and circumferential edges of through holes 20A. In this instance, light-emitting layer 23 is made of a composite consisting of a high-dielectric resin such as fluororubber, cyano group material dispersed with zinc sulfide or the like acting as a basic light emitting material, and dielectric layer 24 is a composite of the similar high-dielectric resin dispersed with barium titanate and the like.

Furthermore, back electrode layer 25 is printed on it into a shape similar to optically transmitting electrode layer 22. Back electrode layer 25 consisting of silver or carbon resin material comprises annular portions 25A formed around through holes 20A and linkage portions 25B connecting these annular portions 25A.

Finally, insulating layer 26 of waterproofing agent such as epoxy resin, polyester resin, and the like is formed over the entire surface of substrate 21. This completes EL element 20 of a structure in which insulating layer 26 of waterproofing property covers not only an area occupied by optically transmitting electrode layer 22, light-emitting layer 23, dielectric layer 24 and back electrode layer 25, but also a bare surface of substrate 21.

In addition, an underside surface of sheet 11 is coated with adhesive material (not show in the figure), and strippable film 15 is affixed on it. Strippable film 15 thus covers movable contacts 13 disposed to fixing holes 11A, to form lighted switch sheet 30. Lighted switch sheet 30 discussed here in this first exemplary embodiment is complete without including strippable film 15. However, strippable film 15 affixed to lighted switch sheet 30 precludes any problem associated with assembly, storage, transportation, and the like of it prior to the installation into a lighted switch unit.

A lighted switch unit employing the lighted switch sheet constructed as above will be described now with reference to FIG. 3.

Figure 3:
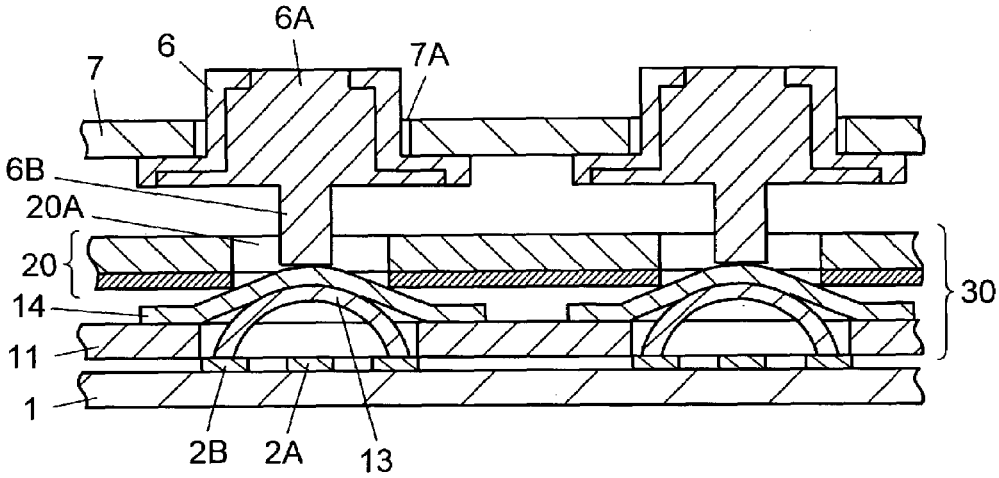
FIG. 3 is a cross sectional view of a lighted switch unit according to the same exemplary embodiment of this invention.

In FIG. 3, wiring board 1 provided with a plurality of wiring patterns (not shown in the figure) formed on both upper and lower surfaces has a plurality of center stationary contacts 2A as well as a plurality of outer stationary contacts 2B formed on the upper surface thereof. Wiring board 1 may be made using a paper-phenolic film, epoxy film containing glass, and the like material.

After strippable film 15 is removed, lighted switch sheet 30 is affixed on wiring board 1 with the adhesive on the underside surface of sheet 11. In this step, movable contacts 13 are positioned in a manner so that bottom peripheral edges seat on their respective outer stationary contacts 2B, and lower center surfaces confront the corresponding center stationary contacts 2A with a predetermined space.

Each of dark-colored push buttons 6 has indicator face 6A exposed above casing 7. Indicator face 6A is translucent, milk-white or similarly colored, and marked with a character, a symbol, a pictorial sign or the like on its upper surface.

Each push button 6 is provided with depressing boss 6B projecting from the lower surface. Depressing boss 6B protrudes downward into through hole 20A of EL element 20, and the bottom end abuts upon a top center portion of the corresponding movable contact 13 via tape 14. Push buttons 6 are made of insulating plastic such as ABS, polycarbonate, acrylic, or the like material. Finally, the lighted switch unit of this invention is completed when they are housed in casing 7 made of insulating plastic. This lighted switch unit has a structure in which a plurality of push buttons 6 project upward and exposed through openings 7A.

The lighted switch unit having the structure as described above operates in a manner, which is described hereinafter.

When any of push buttons 6 is pushed downward, the corresponding one of movable contacts 3 inverts with a click feeling, as a top center portion of it is depressed by a bottom end of depressing boss 6B. A lower center surface of the inverted movable contact 3 comes into contact with center stationary contact 2A, and completes an electrical connection between center stationary contact 2A and outer stationary contact 2B through movable contact 3.

Subsequently, when the depressing force is removed from push button 6, a resilient restoring force of movable contact 3 disconnects the lower center surface from center stationary contact 2A, and pushes back push button 6 upward at the same time to restore it into the original state shown in FIG. 3.

On the other hand, a predetermined operation causes a circuit (not show in the figure) in the electronic apparatus to supply a voltage between optically transmitting electrode layer 22 and back electrode layer 25 of EL element 20 to light-emitting layer 23. Since the light emitted by EL element 20 illuminates push buttons 6 from the underside (i.e.

an interior side of the casing), it helps a user to locate any of push buttons 6, see and identify clearly the characters and the like marked on indicator faces 6A even in a dark environment.

In EL element 20 of this embodiment, optically transmitting electrode layer 22 and back electrode layer 25 are formed only in the areas of annular portions 22A and 25A directly under push buttons 6 around through holes 20A in which depressing bosses 6B of push buttons 6 are placed and where illumination is required, and linkage portions 22B and 25B connecting annular portions 22A and 25A. Therefore, even though light-emitting layer 23 is formed in an extended surface area, it produces illumination only in the area sandwiched between optically transmitting electrode layer 22 and back electrode layer 25. As a result, EL element 20 can illuminate push buttons 6 efficiently with a reduced power as compared to any other case that illuminates an entire area of light-emitting layer 23.

The described structure of the lighted switch sheet according to the first exemplary embodiment can be summarized as follows. That is, sheet 11 houses a plurality of movable contacts 13 of generally a hemispherical shape inside fixing holes 11A. EL element 20 has through holes 20A having a size slightly smaller than that of movable contacts 13 in locations corresponding to and above movable contacts 13. Above-described EL element 20 is affixed on sheet 11 to complete lighted switch sheet 30. Since this structure enables only a single EL element 20 to illuminate the plurality of push buttons 6 above movable contacts 13, it realizes a less expensive lighted switch sheet as well as a lighted switch unit using the same with a small number of components and simple structure.

In addition, since both optically transmitting electrode layer 22 and back electrode layer 25 of EL element 20 are configured in a continuous pattern around the outer peripheries of the plurality of through holes 20A, these layers can be formed only in the areas near the peripheries of through holes 20A, that is directly under push buttons 6, where the illumination is necessary, and thereby the lighted switch sheet can be made even less expensively.

In the above embodiment, although the structure has been described as having two layers, i.e. optically transmitting electrode layer 22 and back electrode layer 25, formed around through holes 20A in the continuous pattern, this invention can be embodied in still another way in which at least one of optically transmitting electrode layer 22, back electrode layer 25 and light-emitting layer 23 is formed around through holes 20A in the continuous pattern.

Furthermore, the embodied structure can improve the waterproofing property of EL element 20, when all of the layers are formed on a surface area slightly inward from the outer edge of substrate 21 and the circumferential edges of through holes 20A, and insulating layer 26 on back electrode layer 25 is formed in a manner to cover all the layers including their outer edges.

(Second Exemplary Embodiment)

Another lighted switch sheet 33 of this invention is described with reference to FIG. 4 and FIG. 5. Like reference numerals are used to designate like structural components as those of the first exemplary embodiment.

Figure 4:
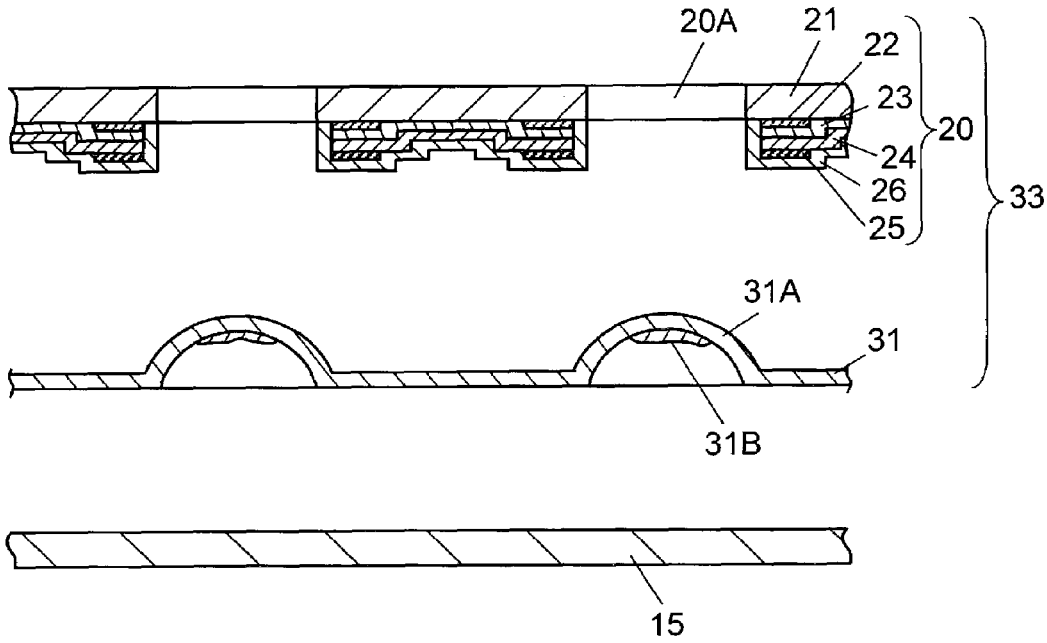
FIG. 4 is an exploded sectional view depicting a lighted switch sheet according to another exemplary embodiment of this invention.
Figure 5:
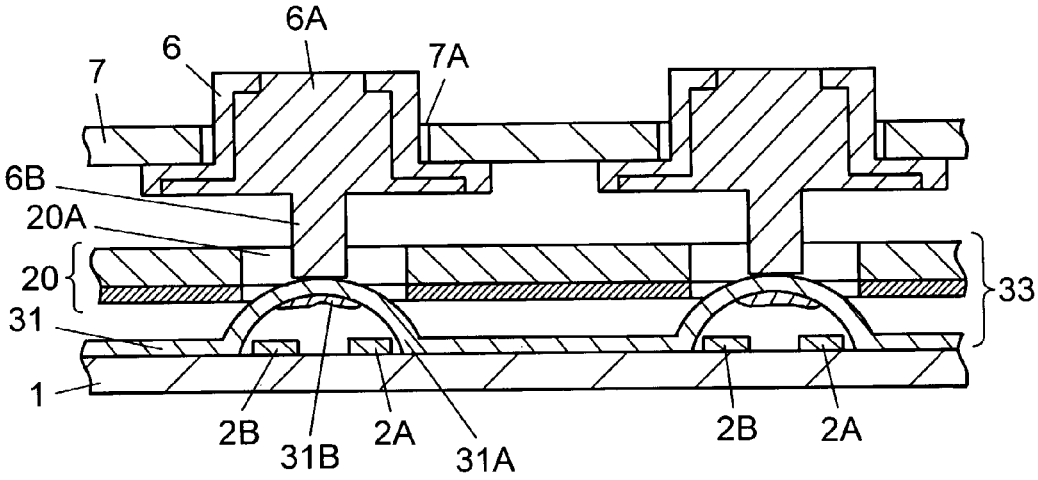
FIG. 5 is a cross sectional view of a lighted switch unit according to another exemplary embodiment of this invention.
Figure 6:
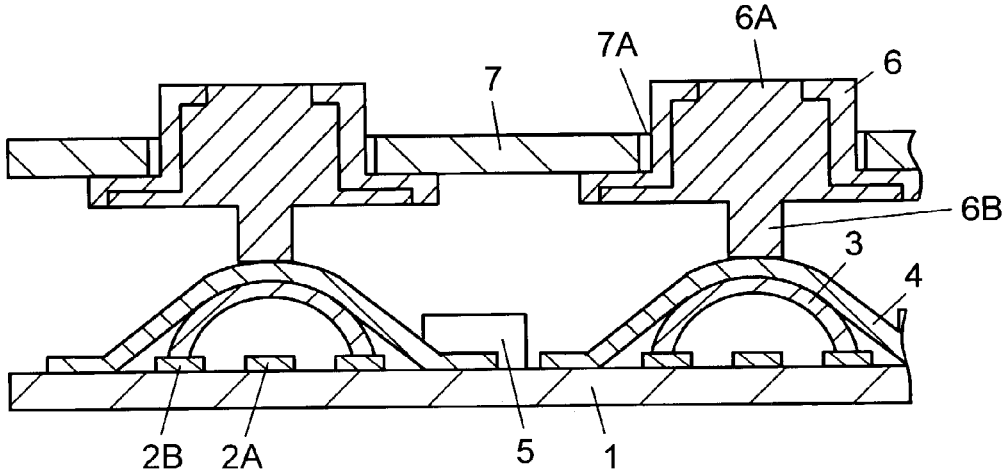
FIG. 6 ( Prior Art )
FIG. 6 is a cross sectional view of a lighted switch unit of the prior art.

This exemplary embodiment is similar to the first exemplary embodiment in respects that a plurality of through holes 20A are formed in EL element 20, optically transmitting electrode layer 22 and back electrode layer 25 are formed in a continuous pattern around the outer peripheries of the plurality of through holes 20A, and these layers are covered with insulating layer 26, as shown in FIG. 4.

Sheet 31 is then affixed on an underside surface of EL element 20. Unlike the structure of the first exemplary embodiment, lighted switch sheet 33 is not provided with movable contacts 13 of resilient thin metal plate, but sheet 31 has a plurality of unitary formed convex portions 31A protruding upward into generally a hemispherical shape.

Each of convex portions 31A is provided with movable contact 31B formed on an underside surface in the center thereof (i.e. inside surface of the hemisphere) by printing silver or carbon resin. Through holes 20A formed in EL element 20 have a shape, which is slightly smaller than an outer diameter of convex portions 31A. Strippable film 15 is then affixed to an underside surface of lighted switch sheet 33 constructed as above.

The above-described lighted switch sheet 33 is affixed on wiring board 1 having a plurality of stationary contacts 2A and 2B in a manner that stationary contacts 2A and 2B confront corresponding movable contacts 31B with a certain space therebetween, and push buttons 6 are placed above EL element 20 to complete the lighted switch unit.

The lighted switch unit of the structure equipped with lighted switch sheet 33 operates in a manner, which is described hereinafter with reference to FIG. 5.

When any of push buttons 6 is pushed, the corresponding one of convex portions 31A inverts with a click feeling, as a top center portion of it is depressed by a bottom end of depressing boss 6B. Movable contact 31B disposed to the underside center surface of the inverted convex portion 31A comes into contact with both stationary contacts 2A and 2B simultaneously. This completes an electrical connection between stationary contacts 2A and 2B through movable contact 31B.

Subsequently, when the depressing force is removed from push button 6, a resilient restoring force of convex portion 31A disengages itself from stationary contacts 2A and 2B, and pushes back push button 6 upward to restore itself into the original state.

On the other hand, a predetermined operation causes EL element 20 to emit light, and illuminate push buttons 6 from the underside (i.e. an interior side of the casing). It thus helps a user to locate any of push buttons 6, see and identify clearly the characters and the like marked on indicator faces 6A even in a dark environment.

According to the second exemplary embodiment, lighted switch sheet 33 is constructed using EL element 20 having through holes 20A of the size slightly smaller than the outer diameter of the generally hemispherical convex portions 31A, which is affixed on sheet 31 having the plurality of upwardly protruding convex portions 31A, each provided with movable contact 31B on the underside surface. Since sheet 31 has the unitary formed movable contacts 31B, this structure realizes a further reduction in the cost of lighted switch sheet 33 with a less number of structural components and a simpler structure, in addition to the advantages provided by the first exemplary embodiment.

In the structures described above, although EL element 20 is illustrated as being affixed directly on any of sheet 11 and sheet 31 with adhesive, these components may be affixed together using a separate film or the like medium with adhesive coated on both sides.

As described, the present invention provides for the advantageous effects of realizing a less expensive lighted switch sheet using a small number of components and a simple structure, as well as a lighted switch unit using the same.

What is claimed is:

1. A lighted switch sheet comprising:

a sheet having a plurality of movable contacts of a hemispherical shape have respectively deflectable portions, said movable contacts contact respective stationary contacts, and an EL element above said stationary contacts, said deflectable contacts extendable above a bottom of said EL element, wherein said sheet has a first surface and a second surface, said movable contacts have convex surfaces of said hemispherical shape on the same side as said second surface, said EL element further comprises an optically transmitting substrate having a third surface and a fourth surface, and said substrate is provided with an optically transmitting electrode layer, a light-emitting layer and a back electrode layer formed in this order on said third surface, said deflectable portions between said third surface and said second surface, and said EL element has through holes of a size slightly smaller than an outer diameter of said movable contacts in positions corresponding to said movable contacts.

2. The lighted switch sheet as set forth in claim 1, wherein said movable contacts are made of metal having resiliency and stored in fixing holes formed in said sheet.

3. The lighted switch sheet as set forth in claim 1, wherein said movable contacts comprise conductor layers formed individually on inner surfaces of convex portions formed in said sheet.

4. The lighted switch sheet as set forth in claim 1, wherein said light-emitting layer is sandwiched between said optically transmitting electrode layer and said back electrode layer in areas around said through holes of said EL element.

5. The lighted switch sheet as set forth in claim 4, wherein at least one of said optically transmitting electrode layer and said back electrode layer comprises pattern electrodes formed only in the areas around said through holes of said EL element, and at least two of said pattern electrodes are connected together.

6. The lighted switch sheet as set forth in claim 1, wherein said EL element further has an insulating layer, said optically transmitting electrode layer, said light-emitting layer and said back electrode layer are formed on said optically transmitting substrate in a surface area slightly inward from an outer edge of said substrate and circumferential edges of said through holes, and said insulating layer covers all said layers including said substrate.

7. The lighted switch sheet as set forth in claim 1 further comprising a strippable film placed on said first surface with adhesive layer.

8. A lighted switch sheet comprising a sheet having a plurality of fixing holes, a plurality of movable contacts of a hemispherical shape disposed individually in said plurality of fixing holes, said movable contacts have respectively deflectable portions, said movable contacts contact respective stationary contacts, and an EL element affixed on said sheet, wherein said sheet has a first surface and a second surface, said movable contacts have convex surfaces of said hemispherical shape on the same side as said second surface, said EL element further comprises an optically transmitting substrate having a third surface and a fourth surface, and said substrate is provided with an optically transmitting electrode layer, a light-emitting layer and a back electrode layer formed in this order on said third surface, said third surface confronts said second surface of said sheet, said EL element has through holes of a size slightly smaller than an outer diameter of said movable contacts in positions corresponding to said movable contacts, said EL element is above said stationary contacts, and said deflectable contacts are extendable above a bottom of said EL element.

9. A lighted switch sheet comprising a sheet having a plurality of convex portions of a hemispherical shape, a plurality of movable contacts formed individually on inner surfaces of said plurality of convex portions, said movable contacts have respectively deflectable portions, said movable contacts contact respective stationary contacts, and an EL element affixed on said sheet, wherein said sheet has a first surface and a second surface, and said plurality of convex portions protrude from said second surface, said EL element further comprises an optically transmitting substrate having a third surface and a fourth surface, and said substrate is provided with an optically transmitting electrode layer, a light-emitting layer and a back electrode layer formed in this order on said third surface, said third surface confronts said second surface of said sheet, said EL element has through holes of a size slightly smaller than an outer diameter of said convex portions in positions corresponding to said convex portions, said EL element is above said stationary contacts, and said deflectable contacts are extendable above a bottom of said EL element.

10. A lighted switch unit comprising a lighted switch sheet, push buttons, a wiring board, and an casing for housing all said components, wherein said lighted switch sheet comprises a sheet having a plurality of movable contacts of a hemispherical shape and an EL element affixed on said sheet, said movable contacts have respectively deflectable portions, said movable contacts contact respective stationary contacts, said sheet has a first surface and a second surface, said movable contacts have convex surfaces of said hemispherical shape on the same side as said second surface, said EL element further comprises an optically transmitting substrate having a third surface and a fourth surface, and said substrate is provided with an optically transmitting electrode layer, a light-emitting layer and a back electrode layer formed in this order on said third surface, said third surface confronts said second surface of said sheet, said EL element has through holes of a size slightly smaller than an outer diameter of said movable contacts in positions corresponding to said movable contacts, said push buttons protrude into said through holes of said EL element, and abut upon convex surfaces of said movable contacts, said wiring board has a plurality of stationary contacts, and confronts said first surface of said sheet in a manner that said plurality of stationary contacts confront concave surfaces of said movable contacts with a predetermined space therebetween, said EL element is above said stationary contacts, and said deflectable contacts are extendable above a bottom of said EL element.

11. The lighted switch unit as set forth in claim 10, wherein said movable contacts are made of metal having resiliency and stored in fixing holes formed in said sheet.

12. The lighted switch sheet as set forth in claim 10, wherein said movable contacts comprise conductor layers formed individually on inner surfaces of convex portions formed in said sheet.

13. The lighted switch unit as set forth in claim 10, wherein said casing has a plurality of openings and confronts said fourth surface, and said push buttons are retained in a vertically movable manner in said openings of said casing.

* * * * *